US005377767A

United States Patent [19]

Briggs

[11] Patent Number: 5,377,767

[45] Date of Patent: Jan. 3, 1995

[54] HOLE DIGGER

[76] Inventor: Roger R. Briggs, 420 Main Road, Bryanston, Transvaal, South Africa

[21] Appl. No.: 159,107

[22] Filed: Nov. 30, 1993

Related U.S. Application Data

[63] Continuation of Ser. No. 963,688, Oct. 20, 1992, abandoned.

[30] Foreign Application Priority Data

Nov. 18, 1991 [ZA] South Africa ..... 91/9109

[51] Int. Cl.[6] ..... E21B 7/02

[52] U.S. Cl. ..... 173/28; 173/185; 173/192; 173/42

[58] Field of Search ..... 173/27, 28, 184, 185, 173/192, 213, 39, 42, 190, 44; 175/170, 171, 195

[56] References Cited

U.S. PATENT DOCUMENTS

| | | | |
|---|---|---|---|
| 2,375,799 | 5/1945 | Tourneau . | |
| 2,903,949 | 9/1959 | Simmonds . | |
| 3,022,839 | 2/1962 | Troche . | |
| 3,073,397 | 1/1963 | Balogh . | |
| 3,306,373 | 2/1967 | Pitman et al. . | |
| 3,527,309 | 9/1970 | Rassieur . | |
| 3,548,604 | 12/1970 | Campbell | 173/192 |
| 3,576,218 | 4/1971 | Lisenby | 173/28 |
| 3,744,574 | 7/1973 | Carley | 173/27 |
| 3,884,359 | 5/1975 | Suverkrop . | |
| 3,999,805 | 12/1976 | Lockwood . | |
| 4,938,296 | 7/1990 | Brazell, II . | |
| 5,094,302 | 3/1992 | Back | 173/28 |

*Primary Examiner*—Eugenia Jones
*Assistant Examiner*—Allan M. Schrock
*Attorney, Agent, or Firm*—Jones, Tullar & Cooper

[57] ABSTRACT

A hole digger assembly which includes a truck, a turntable on the truck, a boom mounted to the truck via links, cylinders between the links and the turntable and between the boom and the turntable for moving the boom, a drill mechanism which is mounted to the boom, and a cylinder for moving the drill mechanism between an operative position and a storage position at which the drill mechanism is parallel to the boom and partly located between two opposed side walls of the boom.

14 Claims, 5 Drawing Sheets

HOLE DIGGER

This application is a continuation of application Ser. No. 07/963,688, filed Oct. 20, 1992, now abandoned.

BACKGROUND OF THE INVENTION

This invention relates generally to a machine for digging holes in the ground.

Poles for power lines and communication purposes, for example, are required to be vertical and arranged in straight lines. The poles may be planted in positions which are relatively inaccessible. It follows that the point at which holes for the poles are made and the directions of the holes may call for precision work and this in turn may demand significant outreach of a crane which is used in making the holes.

One type of hole digger which is known to the applicant as a digger derrick consists of a telescopic mobile crane from which is suspended a torque head. An auger or other type of hole making device which is able to handle the conditions of the ground in which the hole is to be made, is suspended from the crane.

Advantages of the digger derrick include the ability of the crane to be extended to the required extent and then to be positioned so that the hole making device is accurately located at the site of the required hole.

The hole making device may be mounted on a separately slidable saddle so that it can, at an operator's choice, be stowed in a fixed position which enables the crane to be used for conventional lifting purposes, or to be unstowed and attached to a telescoping portion of the crane so that it can be brought precisely to the required site for the hole, which may be some distance from a vehicle which carries the crane.

It is apparent therefore that by extending the crane the hole digging device can be positioned at a location which is not accessible to the vehicle and by adjusting the position of the crane it is not necessary for the vehicle to be parked at a precise distance or orientation relatively to the hole site.

Depending on the nature of the digging device, its digging element may be fed into the ground by downwards motion of the crane. An alternative method which is particularly associated with the drilling of hard rock, involves a feed element which includes a feed track. The crane is used only to place and hold the feed track in position. Drilling is done by rotating a drill head and feeding it down the track using a suitable feed mechanism. This approach eliminates misalignment effects which could be caused by radial movement of the crane, in the digger derrick, and makes it possible to apply greater force to the digging element.

The generation of the required rotary and feed motions for the digging element and the feed element call, in turn, for the provision of a number of services at the end of a boom from which the devices are supported, such as hydraulic oil and compressed air lines. The services however have to cope with the telescopic motion of the boom which occurs when the digging element is readied for work and subsequently is stowed and this requirement can give rise to problems.

SUMMARY OF THE INVENTION

The invention provides a hole digger which includes a base, link means which is pivotally mounted to the base, a boom which is pivotally mounted to the link means, first adjustment means for varying the orientation of the boom relatively to the link means, second adjustment means for varying the orientation of the link means relatively to the base, hole digging means supported by the boom, and means for moving the hole digging means between an operative position and a storage position, the boom including at least two longitudinally extending spaced side walls between which at least a portion of the hole digging means is located when the hole digging means is in the storage position.

The hole digging means may be of any appropriate type and may be of a type which is known per se. The hole digging means preferably includes a drill head which is suspended from one end of the boom and which is rotatable by means of a prime mover. A feed device may be used for applying thrust to a drill, engaged with the drill head, during a drilling operation.

The base may be of any suitable construction and preferably comprises a turntable or equivalent device which is adapted, where required, to be attached to a load area of an appropriate vehicle. This feature enables the orientation of the boom to be adjusted angularly, viewed from above.

The boom may be of any appropriate construction and, preferably, is of a fixed length i.e. is not extensible. One or both of the side walls of the boom may include one or more hollow sections which are adapted to receive services for operating the hole digging means. Such services may for example include compressed air supply lines and hydraulic oil supply lines. The side walls may be interconnected by means of one or more bridging members so that, in essence, a longitudinally extending recess is formed between the side walls and the bridging member or members.

The link means may be provided in any suitable form and may for example comprise a support frame or articulated mechanism. In one form of the invention the link means includes at least two links which are spaced apart with lower ends of the links being pivotally mounted to the base and with upper ends of the links being located on opposing sides of, and being pivotally attached to, the boom.

The first adjustment means may comprise one or more hydraulic cylinders or any equivalent device. Preferably use is made of two hydraulic cylinders which have lower ends which are pivotally mounted to the base and upper ends which are pivotally attached to the boom.

Similarly the second adjustment means may comprise any suitable device and preferably includes one or more hydraulic cylinders opposing ends of which are respectively pivotally connected to the base and to the link means.

The invention further extends to a hole digger assembly which includes a road vehicle, a base turntable which is mounted to the vehicle, link means which is mounted to the base turntable for pivotal movement relatively to the base turntable about a first axis, a boom which is attached to the link means for pivotal movement about a second axis, first cylinder means engaged with the boom to adjust the orientation of the boom relatively to the link means, second cylinder means engaged with the link means to adjust the orientation of the link means relatively to the base turntable, a drilling mechanism which is mounted to an end of the boom for limited pivotal movement relatively to the boom, the boom having two spaced side walls and at least one bridging member extending between the side walls, and means for moving the drilling mechanism between a ground engaging operative position and a storage position at which the drilling mechanism is located substantially parallel to the boom and is housed at least partly between the side walls.

The boom is preferably movable to a transport position at which it is substantially horizontal and overlies at least a portion of the vehicle and also the drilling mechanism when the storage mechanism is in the said storage position.

BRIEF DESCRIPTION OF THE DRAWINGS

The invention is further described by way of example with reference to the accompanying drawings in which.

DESCRIPTION OF PREFERRED EMBODIMENT

Figure 1:
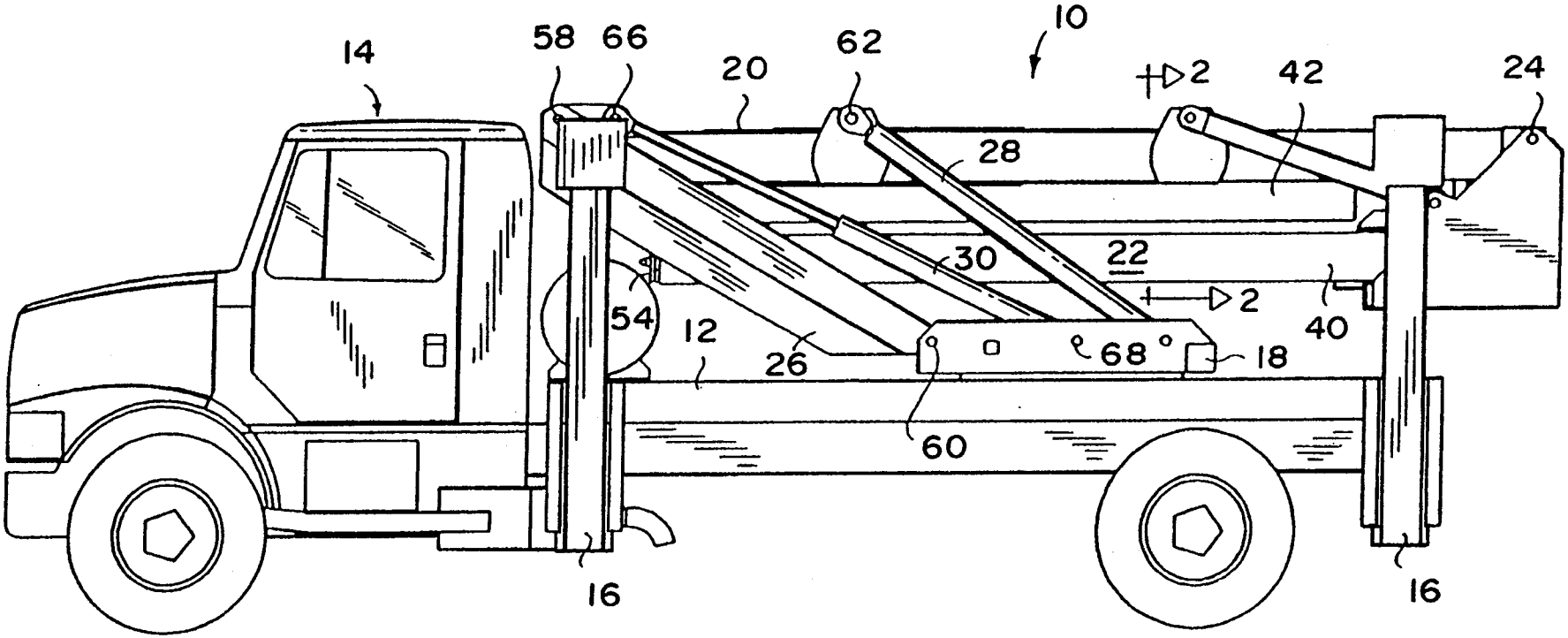
FIG. 1 schematically illustrates from the side a vehicle with a hole digger according to the invention mounted on its load area.

FIG. 1 of the accompanying drawings illustrates a hole digger 10, according to the invention, mounted on a load area 12 of a truck 14. The truck is fitted with stabilizing jacks 16 which are conventional and which are used in a manner which is known per se to stabilize the truck when hole digging is to take place.

Mounted on the load area 12 is a turntable 18 which is of any appropriate construction which enables the turntable to be turned in either direction, as required. The turntable acts as a base for the remainder of the hole digger.

The hole digger includes a boom 20, a drill mechanism 22 which is attached to an end of the boom at a pivot point 24, two links 26, tilt cylinders 28 and cylinders 30.

Figure 2:
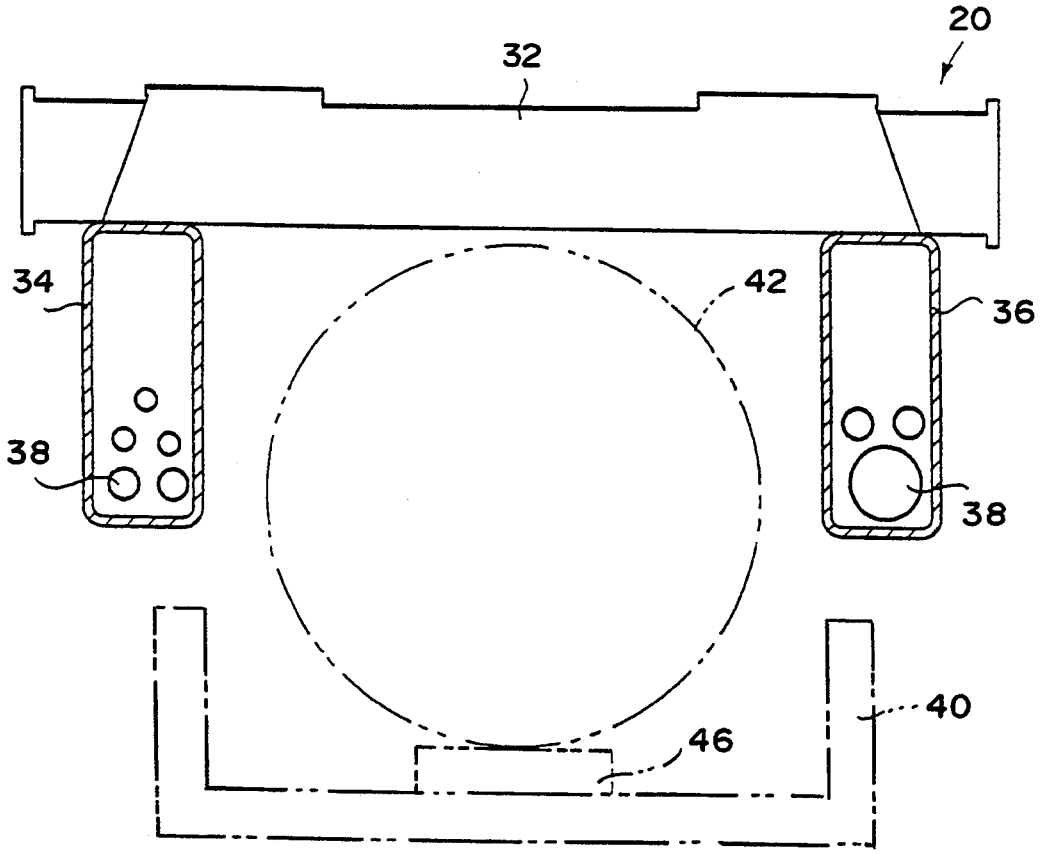
FIG. 2 is an enlarged cross sectional view of portion of the hole digger as shown in Figure I taken on the line 2—2.

The construction of the boom 20 is shown in enlarged detail in the cross sectional view of FIG. 2. The boom includes at least one bridging member 32 which extends between two spaced side walls consisting of hollow sections 34 and 36. Services 38 such as compressed air and hydraulic lines which inter alia power the drill mechanism 22, are located inside the hollow sections 34 and 36.

The bridging member 32 may be extended continuously from one end of the boom to an opposed end, or may be one of a number of similar members which are located at spaced intervals along the length of the boom.

It is to be noted that the boom is of a fixed length. The components of the boom are non-telescopic and the construction, as shown in FIG. 2, is particularly rigid while providing protected storage for the service lines.

Figure 3:
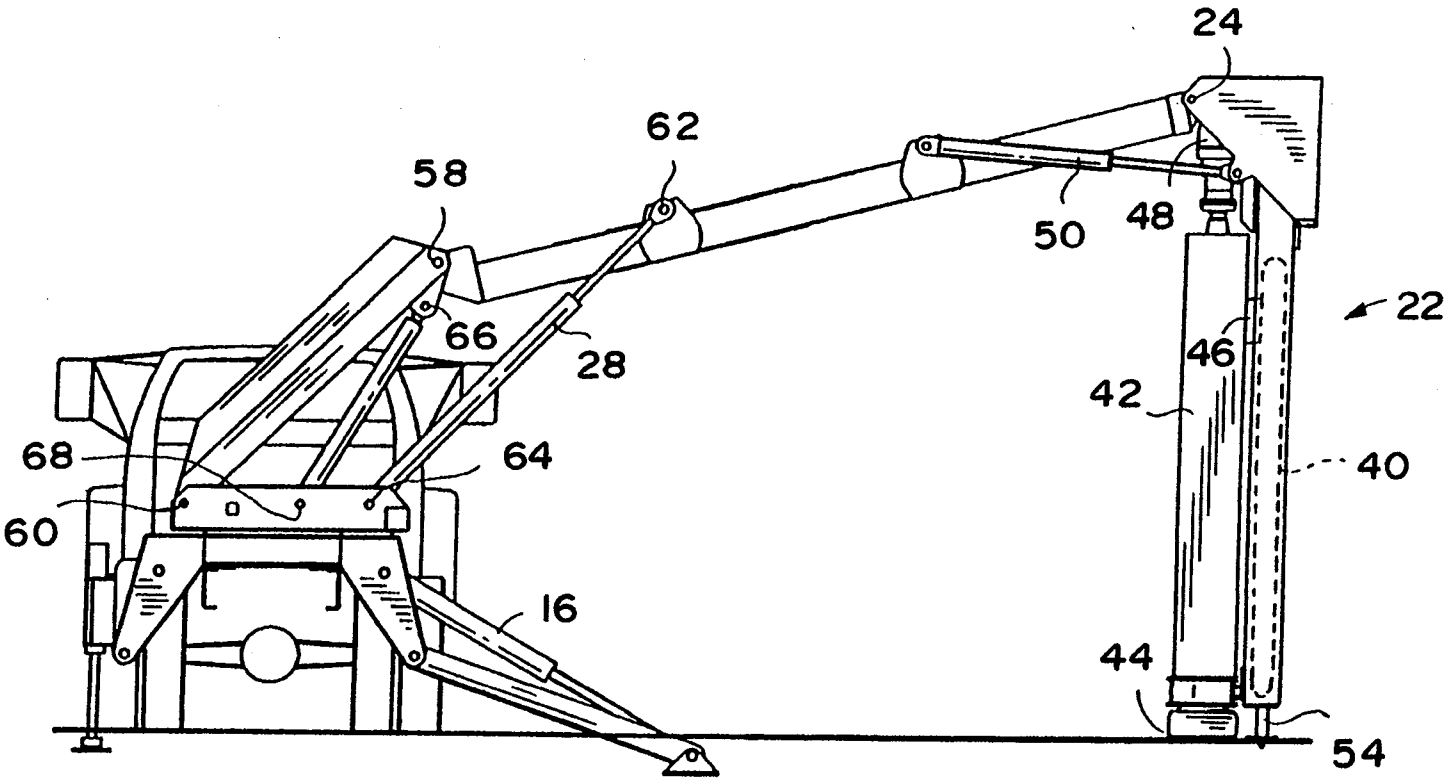
FIGS. 3 and 4 illustrate the way in which the position and orientation of the hole digger can be adjusted relatively to the vehicle.
Figure 4:
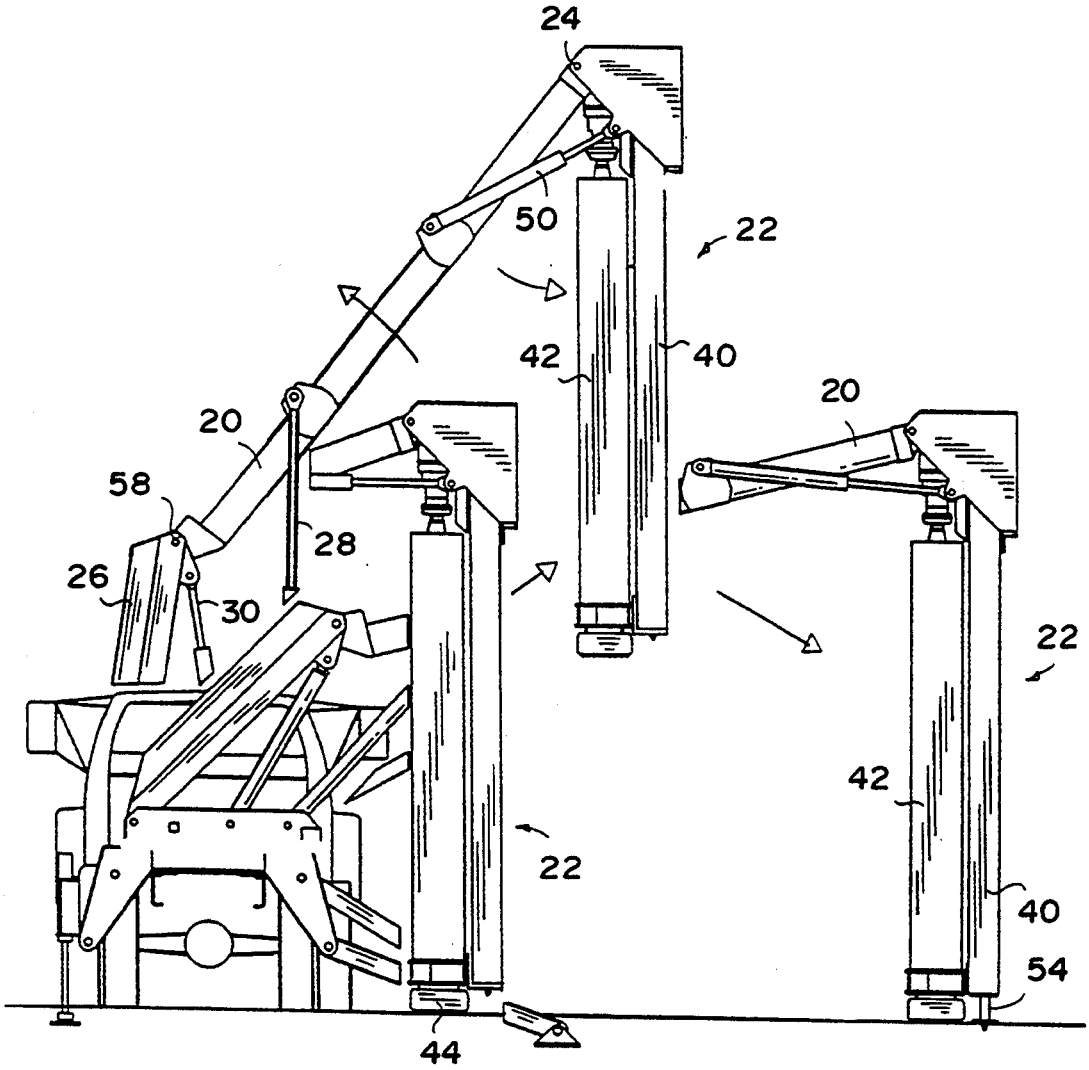

The drill mechanism 22, as is evident from FIGS. 3 and 4, includes a drill support 40, a drill 42 which is mounted to the drill support 40 and which has a drill head 44, and a drill feed 46, of known construction which is used to advance or withdraw the drill 42 parallel and relatively to the drill support. The drill 42 is rotatable by means of a motor 48. The drill feed 46 and the motor 48 are powered by the service lines 38.

As is evident from FIG. 2 the drill 42 is stowed, particularly for transport purposes, at least partially in an elongate recessed formation which is defined by the member 32 and the hollow boom sections 34 and 36. This feature minimizes the height that the hole digger occupies when the drill is in a stowed position as shown in FIG. 1.

One or more hydraulic cylinders 50 are used to control pivotal movement of the drill mechanism relatively to the boom and to lock the drill mechanism in position relatively to the boom during drilling.

The drill mechanism and the boom are shown in stowed positions in FIG. 1. A retaining device 54 at one end of the drill support is engaged with structure on the vehicle to secure the drill mechanism, in a stowed position, to the vehicle. The retaining device 54 is retractable, when required, to allow the drill mechanism to be pivoted relatively to the boom.

The boom and the drill mechanism 22 are supported by means of the links 26. Two links are used, designated 26A and 26B in FIG. 5, and upper ends of the links are pivotally connected to opposed sides of the boom, positioned on an axis 58. The lower ends of the links are pivotally attached to the turntable and are positioned on an axis 60.

There are two tilt cylinders 28, although only one cylinder is shown in FIG. 1. The cylinders are positioned on opposing sides of the boom. Upper ends of the cylinders are fixed to the boom at in-line pivot points 62 while lower ends of the cylinders are fixed to the turntable at in-line pivot points 64.

Similarly there are two of the cylinders which are marked 30 in FIG. 1 and upper ends of these cylinders are fixed to pivot points 66 on the respective links 26A and 26B while lower ends of the cylinders are fixed to points 68 which are in-line and which are on the turntable 18.

Figure 5:
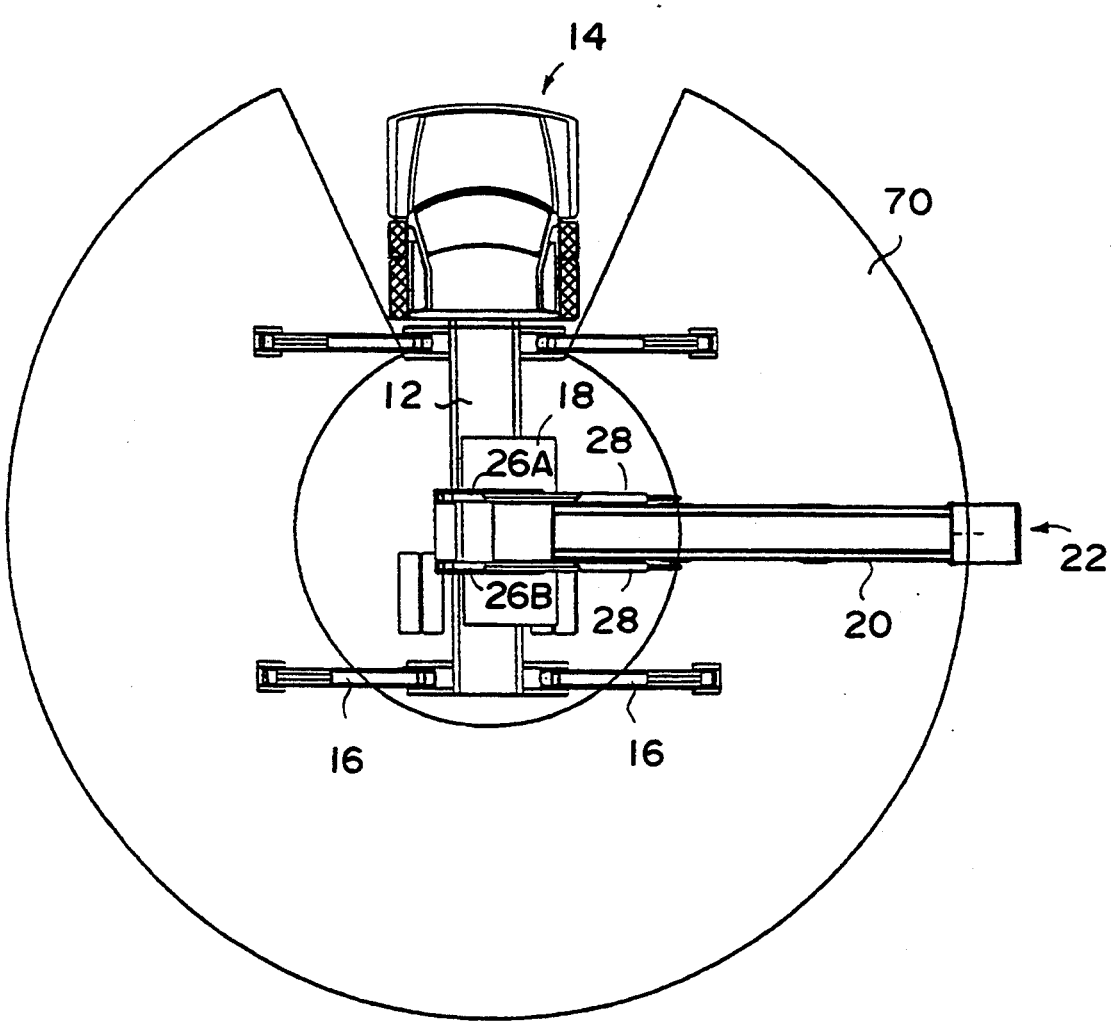
FIG. 5 is a view from above illustrating an arc of operative positions of the hole digger.

FIGS. 3 to 5 illustrate how the position and orientation of the boom and the drill mechanism can be adjusted relatively to the truck, by means of the cylinders 28 and 30.

When the cylinders 28 are extended with the links 26 held stationary by the cylinders 30, the boom pivots upwardly, in an anti-clockwise direction in the drawing, about the axis 58, as shown in FIG. 4.

If the cylinders 30 are extended then the position of the boom relatively to the load area of the truck is adjusted laterally. FIG. 4 shows that when the cylinders 28 and 30 are extended to a maximum extent the boom is at an angle of approximately 45° to the horizontal. Operation of the cylinder 50 causes the drill mechanism 22 to pivot about the pivot point 24. The drill mechanism pivots away from the boom 20 and is then suspended vertically from the boom. By suitable control of the cylinders 28 and 30 the position and orientation of the boom can be adjusted so that the drill head 44 is positioned accurately at a point at which a hole is to be formed in the ground. The orientation of the drill 42 can be aligned directly vertically simply by allowing the drill mechanism to move under gravity action to a vertical position. The cylinder 50 can then be used to lock the drill mechanism in position relatively to the boom. Alternatively the cylinder 50 can be used to fix the drill mechanism in any desired orientation relatively to the boom so that when a hole is drilled this is formed at a desired angle in the ground.

The retaining device 54 is telescopically extensible and retractable. As is shown in FIGS. 3 and 4 this device acts as a sprag foot which allows the drill head to be positioned just above the ground irrespective of the slope of the ground on which the truck is located. The drill mechanism is then anchored firmly to the ground by retraction of the tilt cylinders 28 and in this way the weight of the truck is transferred into the ground partly through the support 40. As has been indicated when the drill mechanism 22 is to be stowed the retaining device 54 is retracted from the ground and once the drill mechanism has been brought alongside the boom the retaining device is extended to lock the components to one another.

FIG. 4 shows three views of the drill mechanism 22 namely elevated, close to the vehicle and engaged with the ground, and remote from the vehicle, engaged with the ground. FIG. 5 on the other hand shows the truck 14 from above, and an arc 70 which is centered on the truck and which bounds the area in which the drill 42 can be placed.

It is apparent that the boom can be adjusted angularly in a vertical sense by operation of the tilt cylinders 28, laterally relatively to the load area by operation of the cylinders 30, and angularly, when viewed in plan, by means of the turntable 18. FIGS. 3 and 5 show that the outreach of the boom can be substantial while FIG. 4 shows that the drill can if necessary be positioned adjacent the truck.

The digger of the invention possesses the following advantages: the inverted U-section of the boom permits the drill to be stowed compactly, in the vertical direction. The strength of the boom is provided by the hollow sections 34 and 36 which at the same time provide protection for the services.

The absence of a conventional turret allows the carriage and convenient stowage of a full-length drill on the truck. This permits deeper single pass holes to be drilled from the truck.

The hole digger in the stowed position shown in FIG. 1 offers an unusually low travel height which cannot be matched by a conventional turret crane equipped with a long drill. The relationship between the boom, which is not extensible, and the drill mechanism provides a compact storage arrangement. It is to be noted that the boom can be of a complex cross section to achieve any desired objective which possibly could be incompatible with a multi-element telescoping boom.

I claim:

1. A hole digger comprising:

A turntable base;

a fixed length boom having a first end, a second end, an underside, first and second longitudinally extending spaced side walls and at least one bridging member connecting said first and second side walls, said first and second side walls and said bridging member having an inverted U-shaped cross section defining an elongated recess along said underside of said boom;

link means having a lower end pivotally mounted to said turntable base for movement about a horizontal axis and an upper end pivotally mounted to said first end of said boom for movement about a horizontal axis;

a first adjustment means for varying the orientation of the boom relative to the link means;

a second adjustment means for varying the orientation of the link means relative to the turntable base;

hole digging means pivotally mounted to said second end of said boom for limited pivotal movement about a horizontal axis relative to said second end of said boom; and wherein said hole digging means between a storage position wherein said hole digging means is at least partially contained within said elongated recess of said boom and a ground engaging operative position wherein said hole digging means is pivoted away from said elongated recess.

2. The hole digger of claim 1, wherein said side walls of said boom are each constructed of hollow sections.

3. The hole digger of claim 2, wherein service lines for said hole digging means are located in at least one of said hollow sections.

4. The hole digger of claim 1, wherein said hole digging means comprises a drill head which is suspended from the second end of said boom and is rotatable by means of a prime mover, and a feed device for applying thrust to a drill, engaged with the drill head, during a drilling operation.

5. The hole digger of claim 1, wherein said turntable base is adapted to be attached to a vehicle.

6. The hole digger of claim 1, wherein said link means further comprises at least two links which are spaced apart with lower ends of the links being pivotally mounted to the turntable base and with upper ends of the links being pivotally mounted to the first end of said boom.

7. The hole digger of claim 1, wherein said first adjustment means includes two hydraulic cylinders with lower ends pivotally mounted to the turntable base and upper ends pivotally attached to said boom.

8. The hole digger of claim 1, wherein the second adjustment means includes at least one hydraulic cylinder having a first end pivotally connected to said turntable base and a second end pivotally connected to said link means.

9. The hole digger of claim 1, further including a telescopically extensible and retractable retaining device attached to said hole digging means for anchoring the hole digging means to the ground when the hole digging means is in a ground engaging operative position.

10. A hole digger assembly comprising:

a road vehicle;

a turntable base mounted to said road vehicle;

a fixed length boom having a first end, a second end, an underside, first and second longitudinally extending spaced side walls and at least one bridging member connecting said first and second side walls, said first and second side walls and said bridging member having an inverted U-shaped cross section defining an elongated recess along said underside of said boom;

link means having a lower end pivotally mounted to said turntable base for movement about a horizontal axis and an upper end pivotally mounted to said first end of said boom for movement about a horizontal axis;

first cylinder means engaged with said boom for adjusting the orientation of the boom relative to the link means;

second cylinder means engaged with the link means for adjusting the orientation of the link means relative to the turntable base;

a drilling mechanism pivotally mounted to said second end of said boom for limited pivotable movement about a horizontal axis relative to said second end of said boom; and means for moving the drilling mechanism between a storage position wherein said drilling mechanism is at least partially contained within said elongated recess of said boom and a ground engaging operative position wherein said drilling mechanism is pivoted away from said elongated recess.

11. The hole digger assembly of claim 10, wherein said boom is movable to a transport position in which the drilling mechanism is in said storage position and said boom is substantially horizontal and overlies at least a portion of the vehicle and the drilling mechanism.

12. The hole digger assembly of claim 11, further including a telescopically extensible and retractable retaining device attached to said drilling mechanism for engaging the vehicle to secure the drilling mechanism to the vehicle when the drilling mechanism is in the storage position and said boom is in the transport position, and for anchoring the drilling mechanism when the drilling mechanism is in a ground engaging operative position.

13. The hole digger assembly of claim 10, wherein said side walls of said boom are each constructed of hollow sections.

14. The hole digger assembly of claim 13, wherein service lines for hole digging means are located in at least one of said hollow sections.

* * * * *

UNITED STATES PATENT AND TRADEMARK OFFICE

CERTIFICATE OF CORRECTION

PATENT NO. : 5,377,767

DATED : January 3, 1995

INVENTOR(S) : ROGER R. BRIGGS

It is certified that error appears in the above-identified patent and that said Letters Patent is hereby corrected as shown below:

Claim 1, col. 6, line 1, "wherein said hole digging means between a storage" should read —wherein said hole digging means is moveable between a storage—.

Col. 8, line 11, "service lines for hole digging means" should read —service lines for said hole digging means—.

Signed and Sealed this

Twenty-fifth Day of April, 1995

*Attest:*

*Attesting Officer*

Bruce Lehman

BRUCE LEHMAN

*Commissioner of Patents and Trademarks*